US007384125B2

(12) United States Patent
Carcia et al.

(10) Patent No.: US 7,384,125 B2
(45) Date of Patent: Jun. 10, 2008

(54) MOVING CHASSIS

(75) Inventors: Anthony Carcia, Portland, OR (US); Alan Shibata, Camas, WA (US); Justin M. Roman, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 443 days.

(21) Appl. No.: 11/098,159

(22) Filed: Apr. 4, 2005

(65) Prior Publication Data

US 2006/0221123 A1 Oct. 5, 2006

(51) Int. Cl.
*B41J 23/00* (2006.01)

(52) U.S. Cl. ..... 347/37

(58) Field of Classification Search ..... 347/37, 347/104, 109

See application file for complete search history.

(56) References Cited

U.S. PATENT DOCUMENTS 5,078,385 A 1/1992 Serita
6,003,864 A 12/1999 Kuo et al.
6,511,153 B1 1/2003 Ishikawa
6,843,549 B2 1/2005 Cajigas et al.
7,220,068 B2 * 5/2007 Silverbrook ..... 400/88

FOREIGN PATENT DOCUMENTS

| | | |
|---|---|---|
| EP | 0547308 | 6/1993 |
| JP | 60262764 | 12/1985 |
| JP | 8225218 | 9/1996 |

* cited by examiner

*Primary Examiner*—An H Do

(57) ABSTRACT

An apparatus includes a print chassis supporting a print engine within a chassis structure, and a handle engaged with the print chassis to move both the print chassis and the print engine in a first direction and a second direction, wherein the second direction is substantially orthogonal to the first direction.

24 Claims, 4 Drawing Sheets

MOVING CHASSIS

BACKGROUND

End of isle office copiers can be expensive to maintain. Typically, maintaining such copiers involves dispatching a service person to the copier's location to perform a major disassembly of components. This leaves room for technician errors in reassembly and increased downtime for a service visit. Accordingly, the ease of servicing and maintaining such copiers has an impact on overall system cost.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical items.

DETAILED DESCRIPTION

Exemplary techniques for moving a print chassis are described. In one embodiment, a print chassis is a support structure in an imaging device (such as a printer, copier, and the like) that provides support for a print engine (e.g., 106 discussed with reference to FIG. 1A). The techniques described herein are also envisioned to apply to non-imaging applications, e.g., where a component within a serviceable product is to be moved and/or removed.

Some embodiments provide efficient and/or speedier maintenance or service, for example, by providing a user or service personnel easier access to a relatively densely populated print engine. The print engine may be present in any suitable printing (or imaging) product such as a copier, a printer, an all-in-one device (e.g., providing scanning, copying, printing, and/or faxing), and the like. In one embodiment, a user may lift the print chassis out of the way in order to clear a paper jam. Also, a service personnel may extract (e.g., by sliding) the print chassis out of the printing product to gain access to other parts of the product and/or the chassis subparts (such as discussed further with reference to FIG. 1A). Such implementations are envisioned to reduce maintenance costs and/or delays associated with resolving service or maintenance issues.

Figure 1A:
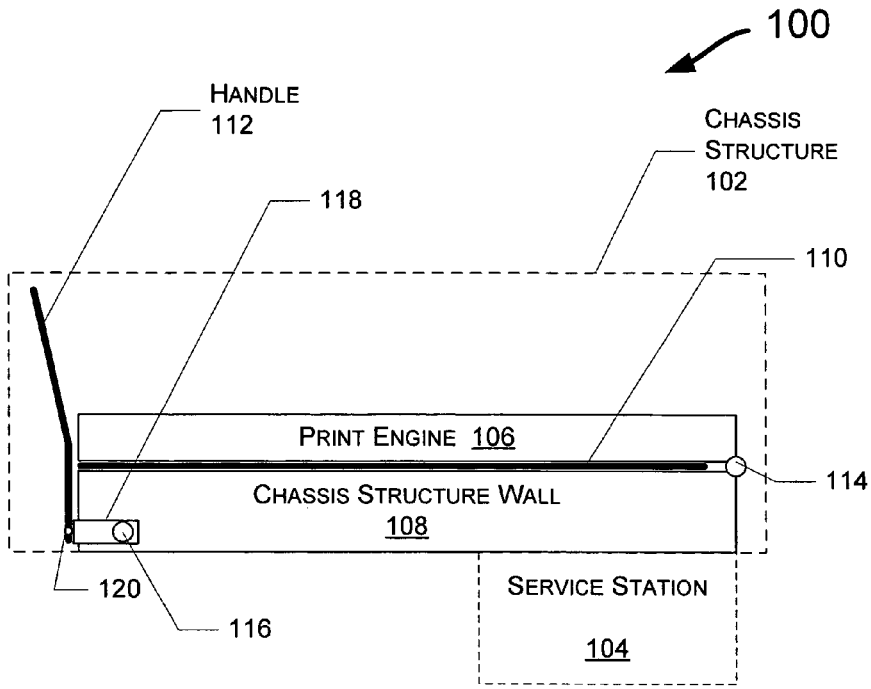
FIG. 1A illustrates a system for moving a print chassis, according to an embodiment.

FIG. 1A illustrates a system 100 for moving a print chassis, according to an embodiment. The system 100 may be part of any suitable imaging product such as a copier, a printer, an all-in-one device (e.g., providing scanning, copying, printing, and/or faxing), and the like.

The system 100 includes a chassis structure 102 and an optional service station 104. The chassis structure 102 houses a print engine 106 such as a laser printer engine, one or more inkjet print heads, and the like. The service station 104 may provide appropriate media for cleaning portions of the print engine 106. As will be further discussed for example with reference to FIG. 2, portions of the chassis structure 102 may be moved to provide access to portions of the chassis structure 102 and/or the service station 104.

Figure 2:
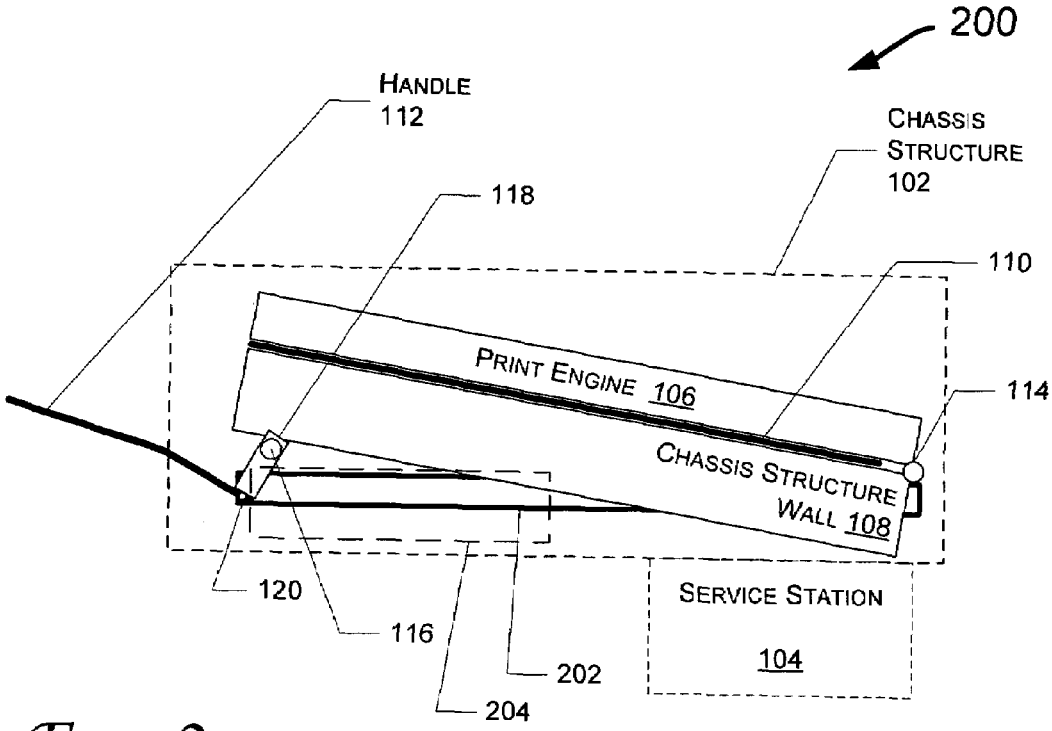
FIG. 2 illustrates a system for clearing paper jams by lifting portions of the system of FIG. 1A, according to an embodiment.

The chassis structure 102 also includes a chassis structure wall 108 (e.g., to provide structural support for the chassis structure 102), a rod 110 (e.g., to allow portions of the print engine 106, such as print heads, to slide back and forth over a print media), a handle 112 (e.g., to allow movement of portions of the chassis structure 102 as will be further discussed herein, for example, with respect to FIG. 2), and a pivot member 114 (such as a wheel, bearing, roller, pin, and the like, e.g., to allow pivoting of portions of the chassis structure 102 such as discussed further with reference to FIG. 2). The handle 112 may be coupled to a pivot member 116 (such as a wheel, bearing, roller, pin, and the like), for example, through a support structure 118. Moreover, the handle 112 may be pivoted about a pivot 120 (such as a pin, screw, shaft, rivet, and the like).

Figure 1B:
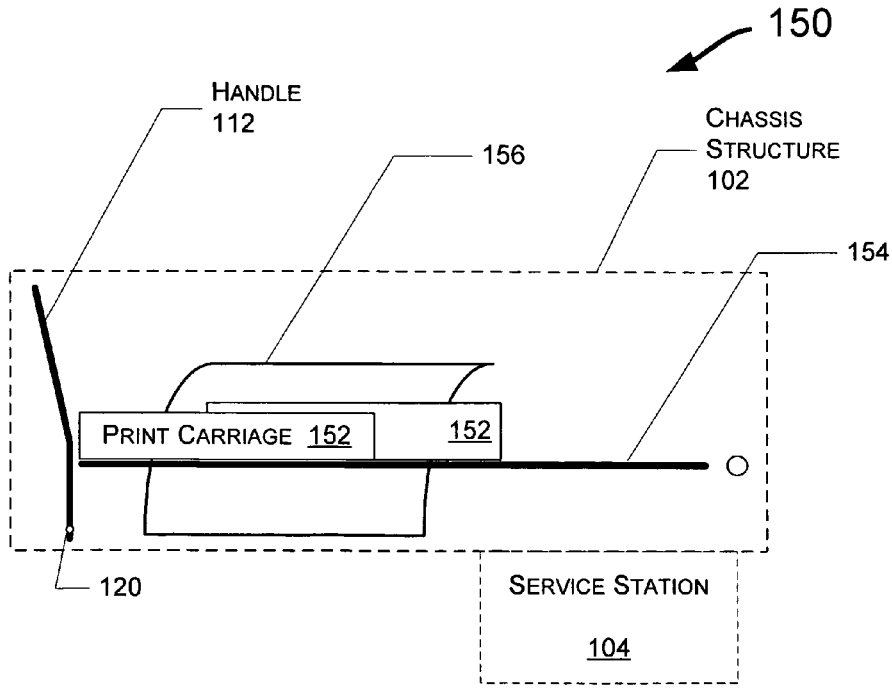
FIG. 1B illustrates a print carriage system according to an embodiment.

FIG. 1B illustrates a print carriage system 150 according to an embodiment. The system 150 includes one or more print carriages 152 that slide along one or more carriage rods 154 to deposit ink onto a print media 156. The print media 156 may be advance under the print carriages 152 with one or more rollers (not shown). For example, as illustrated in FIG. 1B, two print carriages (152) may slide along the carriage rod 154 where each print carriage deposits ink for a given portion of the print media 156 (e.g., top versus a bottom portion of a print media, respectively). In one embodiment, the carriage rod 154 may be the same or similar to the rod 110 of FIG. 1A. In an embodiment, the print carriage 152 may support a print engine (e.g., 106 discussed with reference to FIG. 1A). Also, the print carriage 152 may be part of the print chassis that includes the print engine 106, chassis structure wall 108, the rod (110 and/or 154), and/or the pivot member 114, in one embodiment.

FIG. 2 illustrates a system 200 for clearing paper jams by lifting portions of the system of FIG. 1A, according to an embodiment. In one embodiment, the system 200 includes portions of the system 100 of FIG. 1A that have been lifted by rotating the handle 112 away from the chassis structure 108. In particular, the system 200 includes the chassis structure 102, the service station 104, the print engine 106, the chassis structure wall 108, the rod 110, the handle 112, the pivot members 114 and 116, the support structure 118, and the pivot 120.

As illustrated in FIG. 2, the system 200 may further include a structural member 202, e.g., to provide structural support for the chassis structure 102. In one embodiment, the pivot 120 may couple the handle 112 pivotally to the structural member 202. As illustrated, moving the handle 112 away from the chassis structure 108 results in the handle 112 pivoting about the pivot 120 and, in turn, lifting the pivot member 116, thereby raising and pivoting the print chassis (including the print engine 106, chassis structure wall 108, the rod 110, and/or the pivot member 114, in one embodiment) about the pivot member 114. As a result, the pivot member 114 rests on the structural member 202. The additional gap provided by lifting the portions of the chassis structure 102 (such as the print engine 106) is envisioned to allow clearing of paper jams in the system 200. For example, the additional gap may provide sufficient clearance to access paper jams between a drum 204 and the raised structure (including the print engine 106, the chassis structure wall 108, the rod 110, and/or the pivot member 114, in one embodiment).

Figure 3:
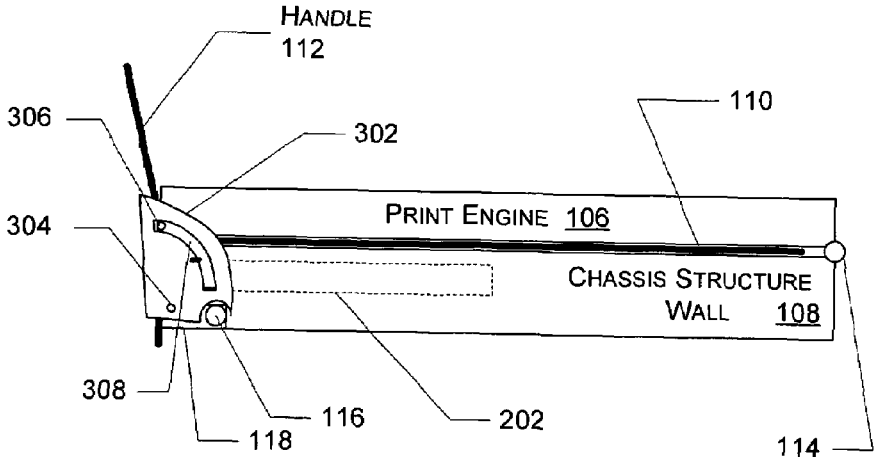
FIG. 3 illustrates portions of the chassis structure 102 of FIG. 1A, according to an embodiment.

FIG. 3 illustrates portions of the chassis structure 102 of FIG. 1A, according to an embodiment. A latch 302 is pivotally coupled to the chassis structure wall 108 via a pivot 304 (such as a pin, screw, shaft, rivet, and the like). Accordingly, the latch 302 may pivot about the pivot 304 as will be further discussed with reference to FIG. 4. Also, the latch 302 may rotate independent of the handle 112, e.g., by maintaining coupling to the chassis structure wall 108. A sliding member 306 (such as a pin, screw, shaft, rivet, and the like) in an opening 308 (within the latch 302) may also be coupled the chassis structure wall 108, e.g., to facilitate the movement of the latch 302 with the chassis structure wall 108.

Figure 4:
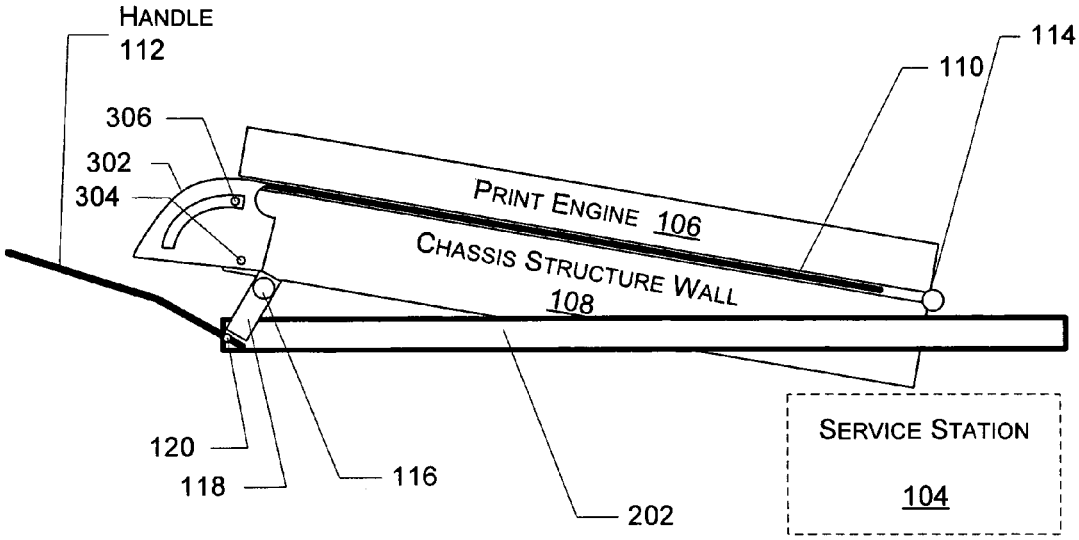
FIG. 4 illustrates movement of portions of the chassis structure 102 of FIG. 1A, according to an embodiment.

FIG. 4 illustrates movement of portions of the chassis structure 102 of FIG. 1A, according to an embodiment. As illustrated in FIG. 4, after the handle 112 is rotated and the latch 302 is decoupled from the pivot member 116 (e.g., by pivoting the latch 302 about the pivot 304), the print chassis (including the print engine 106, chassis structure wall 108, the rod 110, the pivot member 114, and/or the pivot member 114, in an embodiment) may be slid (e.g., on the pivot member 114 and over the pivot member 116) away from the service station 104. This is envisioned to provide access to internal portions of the chassis structure 102 and/or the service station 104 for maintenance and/or service purposes, without disassembly of components.

Figure 5:
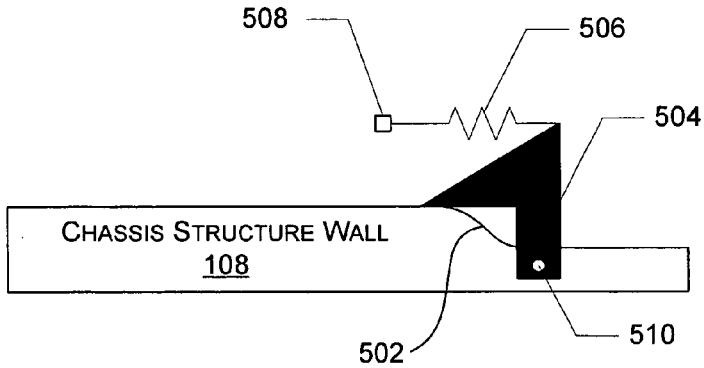
FIG. 5 illustrates another implementation of the chassis structure wall 108 of FIG. 1A, according to an embodiment.

FIG. 5 illustrates another implementation of the chassis structure wall 108 of FIG. 1A, according to an embodiment. As illustrated in FIG. 5, a region 502 of the chassis structure wall 108 has a profile to receive a cam 504 as the chassis structure wall 108 is moved such as discussed with reference to FIGS. 2 and 4. The cam 504 is coupled to an elastic member 506, e.g., to provide a downward force approximately constant in magnitude and/or direction through the entire motion of portions of the chassis structure 102 (such as illustrated by FIG. 4). The elastic member 506 may be any suitable member capable of recovering its original shape when released after being distorted such as a spring, rubber material, solenoid, air piston, and the like. The elastic member 506 is coupled to a fixation point 508 which may be rigidly attached to nonmoving structural support members such as the structural member 202. As illustrated in FIG. 5, a pivot member 510 permits the cam 504 to pivot as the chassis structure wall 108 moves (such as discussed with reference to FIG. 6). In one embodiment, the pivot member 510 is coupled to the structural member 202 of FIG. 2.

Figure 6:
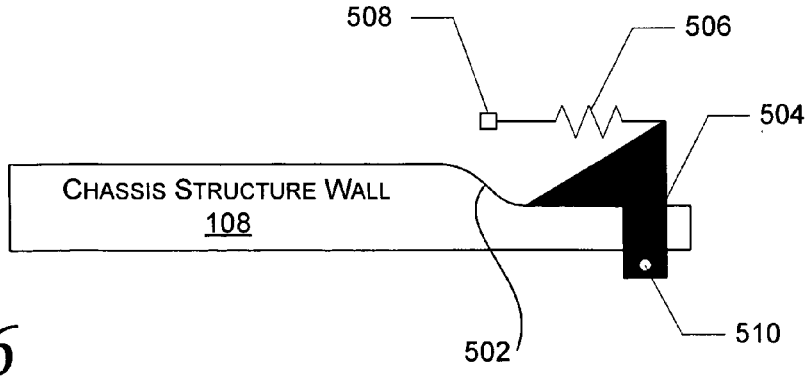
FIG. 6 illustrates the elements of FIG. 5 after the chassis structure wall 108 of FIG. 5 has moved, according to an embodiment.

FIG. 6 illustrates the elements of FIG. 5 after the chassis structure wall 108 of FIG. 5 has moved, according to an embodiment. As illustrated, the cam 504 follows the profile 502 when the chassis structure wall 108 is moved (as discussed with reference to FIG. 4), thereby maintaining the force exerted by the elastic member 506 approximately constant in magnitude and/or direction through the entire motion discussed with reference to FIG. 4.

Figure 7:
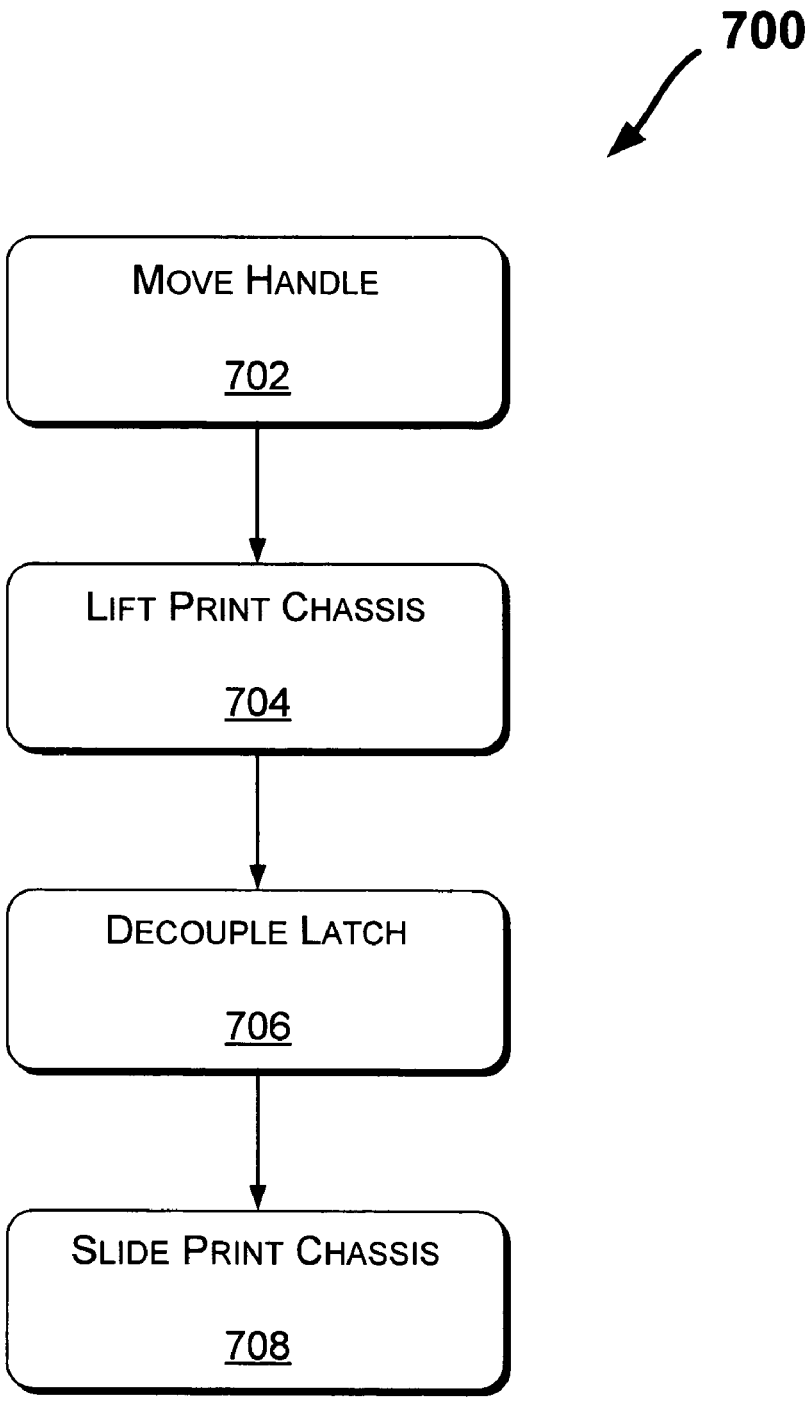
FIG. 7 illustrates a method of moving a print chassis, according to an embodiment.

FIG. 7 illustrates a method 700 of moving a print chassis, according to an embodiment. In one embodiment, the method 700 may be performed to move portions of the chassis structure 102 of FIG. 1A such as discussed with reference to FIGS. 2 and 4. The portions moved may include the print chassis (e.g., including the print engine 106, chassis structure wall 108, the rod 110, and/or the pivot member 114 of FIG. 1A, in one embodiment). More specifically, a handle that is slideably engaged with a chassis is moved (702) to move the print chassis. The handle may be the handle 112 of FIG. 1A. The print chassis may be moved to provide access to a paper jam located in vicinity of the print chassis (e.g., under the print engine), for example, by lifting the print chassis (704).

A latch coupled to a pivot member is decoupled (706), such as discussed with reference to FIG. 4 (e.g., decoupling the latch 302 from the pivot member 116), to allow for sliding of the print chassis (708). As discussed with reference to FIG. 4, the pivot member (116) may slide over a nonmoving structural member (202). Hence, the chassis may be moved in two (different) directions (e.g., up and away from the service station 104 of FIG. 1A). The two directions may be substantially orthogonal to each other. Also, as discussed with reference to FIGS. 5 and 6, a force may be maintained through the motion of the print chassis that is approximately constant in magnitude and/or direction.

Reference in the specification to "one embodiment" or "an embodiment" means that a particular feature, structure, or characteristic described in connection with the embodiment is included in at least an implementation. The appearances of the phrase "in one embodiment" in various places in the specification may or may not be referring to the same embodiment.

Thus, although embodiments have been described in language specific to structural features and/or methodological acts, it is to be understood that the claimed subject matter may not be limited to the specific features or acts described. Rather, the specific features and acts are disclosed as exemplary forms of implementing the claimed subject matter.

What is claimed is:

1. An apparatus comprising:

a print chassis supporting a print engine within a chassis structure; and a handle engaged with the print chassis to move both the print chassis and the print engine in a first direction and a second direction substantially orthogonal to the first direction.

2. The apparatus of claim 1, wherein the handle is pivotally attached to a nonmoving structural member of the chassis structure.

3. The apparatus of claim 2, wherein the handle is rigidly coupled to a first pivot member, wherein the first pivot member lifts the print chassis and the print engine in the first direction when the handle is rotated about a pivot attached to the nonmoving structural member of the chassis structure.

4. The apparatus of claim 3, further comprising a latch pivotally coupled to a chassis structure wall of the print chassis and selectively coupled with the first pivot member, wherein the latch allows sliding of the print chassis and the print engine in the second direction once the latch is decoupled from the first pivot member.

5. The apparatus of claim 3, wherein the print chassis includes a second pivot member configured to slide over the nonmoving structural member of the chassis structure when the print chassis and the print engine are moved in the second direction.

6. The apparatus of claim 5, wherein at least one of the first and second pivot members are selected from a group comprising a wheel, a bearing, a pin, and a roller.

7. The apparatus of claim 3, wherein the pivot is selected from a group comprising a pin, a screw, a shaft, and a rivet.

8. The apparatus of claim 1, wherein the print chassis includes one or more carriage rods configured to move with the print chassis and the print engine in the first direction and the second direction.

9. The apparatus of claim 8, wherein the print chassis includes one or more print carriages configured to support the print engine and slide along the one or more carriage rods.

10. The apparatus of claim 9, wherein, during printing, the one or more print carriages are configured to slide along the one or more carriage rods in a direction substantially parallel with the second direction.

11. The apparatus of claim 1, wherein the print chassis is part of a printing product and is configured to slide out of and away from the printing product without disassembly of components of the printing product.

12. The apparatus of claim 1, wherein the print chassis includes a chassis structure wall having a profile configured to receive a cam as the chassis structure wall is moved with the print chassis in the first direction and the second direction, wherein the cam and the profile maintain a force approximately constant in one of magnitude and direction through a motion of the print chassis.

13. The apparatus of claim 12, wherein the force is exerted by an elastic member.

14. The apparatus of claim 12, wherein the cam is pivotally attached to a nonmoving structural member of the chassis structure.

15. The apparatus of claim 1, wherein the print chassis slidably supports the print engine within the chassis structure, and wherein, during printing, the print engine is configured to slide in a direction substantially parallel with the second direction.

16. A method comprising:

supporting a print engine by a print chassis within a chassis structure; and moving a handle engaged with the print chassis to move both the print chassis and the print engine in a first direction and a second direction substantially orthogonal to the first direction.

17. The method of claim 16, wherein the handle is pivotally attached to a nonmoving structural member of the chassis structure, and wherein moving the handle includes rotating the handle about a pivot attached to the nonmoving structural member.

18. The method claim 17, wherein rotating the handle about the pivot results in lifting a first pivot member coupled to the handle, raising the print chassis and the print engine in the first direction with the first pivot member, and pivoting the print chassis and the print engine about a second pivot member resting on the nonmoving structural member.

19. The method of claim 18, further comprising decoupling a latch from the first pivot member to allow sliding of the print chassis and the print engine in the second direction.

20. The method of claim 18, further comprising sliding the second pivot member over the nonmoving structural member to move the print chassis and the print engine in the second direction.

21. The method of claim 17, wherein rotating the handle about the pivot includes rotating the handle away from the chassis structure.

22. The method of claim 16, further comprising maintaining a force approximately constant in one of magnitude and direction through a motion of the print chassis.

23. The method of claim 16, wherein supporting the print engine includes supporting the print engine on one or more carriage rods of the print chassis, wherein the one or more carriage rods move with the print chassis and the print engine in the first direction and the second direction.

24. The method of claim 23, wherein supporting the print engine on the one or more carriage rods includes supporting the print engine with one or more print carriages configured to slide along the one or more carriage rods.

* * * * *

UNITED STATES PATENT AND TRADEMARK OFFICE

CERTIFICATE OF CORRECTION

PATENT NO. : 7,384,125 B2
APPLICATION NO. : 11/098159
DATED : June 10, 2008
INVENTOR(S) : Anthony Carcia et al.

It is certified that error appears in the above-identified patent and that said Letters Patent is hereby corrected as shown below:

In column 6, line 7, in Claim 18, after "method" insert -- of --.

Signed and Sealed this

Twenty-third Day of September, 2008

JON W. DUDAS
*Director of the United States Patent and Trademark Office*